US012686523B2

(12) United States Patent
Hoffman

(10) Patent No.: US 12,686,523 B2
(45) Date of Patent: Jul. 21, 2026

(54) SYSTEMS AND METHODS FOR PHARMACEUTICAL CONTAINER PROCESSING

(71) Applicant: Express Scripts Strategic Development, Inc., St. Louis, MO (US)

(72) Inventor: Robert E. Hoffman, Linden, IN (US)

(73) Assignee: Express Scripts Strategic Development, Inc., St. Louis, MO (US)

( * ) Notice: Subject to any disclaimer, the term of this patent is extended or adjusted under 35 U.S.C. 154(b) by 382 days.

(21) Appl. No.: 18/232,944

(22) Filed: Aug. 11, 2023

(65) Prior Publication Data

US 2023/0382588 A1 Nov. 30, 2023

Related U.S. Application Data

(63) Continuation of application No. 16/564,033, filed on Sep. 9, 2019, now Pat. No. 11,772,838.

(51) Int. Cl.
*B65B 69/00* (2006.01)

(52) U.S. Cl.
CPC ..... *B65B 69/0033* (2013.01)

(58) Field of Classification Search
CPC ..... B65B 69/0033; B65B 69/005; B65B 69/0008; B65B 69/0041
USPC ..... 414/412
See application file for complete search history.

(56) References Cited

U.S. PATENT DOCUMENTS

| | | | | |
|---|---|---|---|---|
| 1,911,525 | A * | 5/1933 | Neuman | B65B 69/0008 198/560 |
| 6,026,561 | A | 2/2000 | Lafond | |
| 6,971,541 | B2 | 12/2005 | Williams | |
| 7,530,211 | B2 | 5/2009 | McErlean | |
| 8,117,809 | B2 | 2/2012 | Mcerlean | |
| 8,539,742 | B2 | 9/2013 | Mcerlean | |
| 9,181,076 | B2 | 11/2015 | Tomlinson | |
| 2004/0123567 | A1* | 7/2004 | McErlean | B65C 9/22 53/445 |
| 2006/0242930 | A1* | 11/2006 | Chambers | B65B 69/0033 53/381.2 |
| 2008/0056865 | A1* | 3/2008 | Laing | B65B 69/0033 414/412 |
| 2008/0105444 | A1 | 5/2008 | Lafleur | |
| 2010/0258565 | A1 | 10/2010 | Isaacson | |
| 2012/0109081 | A1 | 5/2012 | Romano | |
| 2012/0192973 | A1 | 8/2012 | Klepach | |
| 2017/0158369 | A1* | 6/2017 | Dopfer | B65B 69/0033 |
| 2018/0127192 | A1* | 5/2018 | Cohen | G07F 11/68 |
| 2018/0369898 | A1 | 12/2018 | Anagnostopoulos | |
| 2019/0120686 | A1* | 4/2019 | Oriols Gaja | G01G 15/00 |

(Continued)

*Primary Examiner* — Glenn F Myers
(74) *Attorney, Agent, or Firm* — Stinson LLP

(57) ABSTRACT

A pharmaceutical extractor and associated components and methods for removing pharmaceuticals from a plurality of containers. The extractor includes a plurality of holders. Each holder is configured to hold at least one container of the plurality of containers. Each holder is repeatedly cycled through a series of container operation locations of the pharmaceutical extractor. In the series of container operation locations, the holders receive containers, the containers are cut to form pharmaceutical outlets in the containers, pharmaceuticals are moved out of the pharmaceutical outlets, and empty containers are dropped by the holders.

20 Claims, 10 Drawing Sheets

(56) References Cited

U.S. PATENT DOCUMENTS

| | | | |
|---|---|---|---|
| 2019/0126331 | A1 | 5/2019 | Vanderwoude |
| 2019/0367275 | A1 | 12/2019 | Hoffman |
| 2019/0371448 | A1 | 12/2019 | Hoffman |

* cited by examiner

SYSTEMS AND METHODS FOR PHARMACEUTICAL CONTAINER PROCESSING

CROSS REFERENCE TO RELATED APPLICATIONS

This application is a continuation of U.S. application Ser. No. 16/564,033, which was filed Sep. 9, 2019. The entire disclosure of said application is incorporated herein by reference.

FIELD

The present disclosure generally relates to pharmacy order processing systems, and more particularly to pharmaceutical container processing systems for removing pharmaceuticals from containers and related methods.

BACKGROUND

Pharmaceutical order processing systems typically involve labor intensive processes to remove pharmaceuticals from manufacturer packaging and transfer the pharmaceuticals to a bulk storage container. Once in the bulk storage container, the pharmaceuticals can be used to fill pharmacy orders.

BRIEF SUMMARY

In one aspect, a pharmaceutical extractor for removing pharmaceuticals from a plurality of containers comprises a plurality of holders and a plurality of container operation locations. Each holder includes a gripper configured to hold at least one container of the plurality of containers. The plurality of container operation locations are arranged in a series of container operation locations along which the pharmaceutical extractor is configured to perform a series of container operations. A cutter is located along the series of container operation locations. The cutter is configured to cut containers held by the grippers to create pharmaceutical outlets in the containers. A pharmaceutical collection inlet is located along the series of container operation locations. The pharmaceutical collection inlet is configured to receive pharmaceuticals from the pharmaceutical outlets in the containers. The pharmaceutical extractor is configured to move the plurality of holders, one holder after another holder, along the series of container operation locations to extract the pharmaceuticals from the containers.

In another aspect, a pharmaceutical container processing system for removing pharmaceuticals from a plurality of containers comprises a hopper configured to hold the plurality of containers and to dispense the plurality of containers. A singulator assembly is configured to singulate the plurality of containers as the containers are dispensed from the hopper. A pharmaceutical extractor is configured to remove the pharmaceuticals from the plurality of containers. The pharmaceutical extractor includes a holder configured to hold at least one container of the plurality of containers and a cutter configured to cut said at least one container held by the holder to create a pharmaceutical outlet in said container. The holder is configured to move between a first location where the holder receives said container, a second location where the cutter cuts the pharmaceutical outlet in said container and third location where the pharmaceuticals in said container move through the pharmaceutical outlet and out of said container. A pharmaceutical collector is configured to receive the pharmaceuticals from the containers disposed at the third location.

In another aspect, a method of removing pharmaceuticals from a plurality of containers comprises receiving a first container of the plurality of containers in a first holder of a pharmaceutical extractor at a first location, moving said first container and first holder to a second location, forming a pharmaceutical outlet in said first container while said first container is held by the first holder at the second location, moving said first container and first holder to a third location and moving pharmaceuticals out of said first container through the pharmaceutical outlet while said first container is held by the first holder at the third location.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
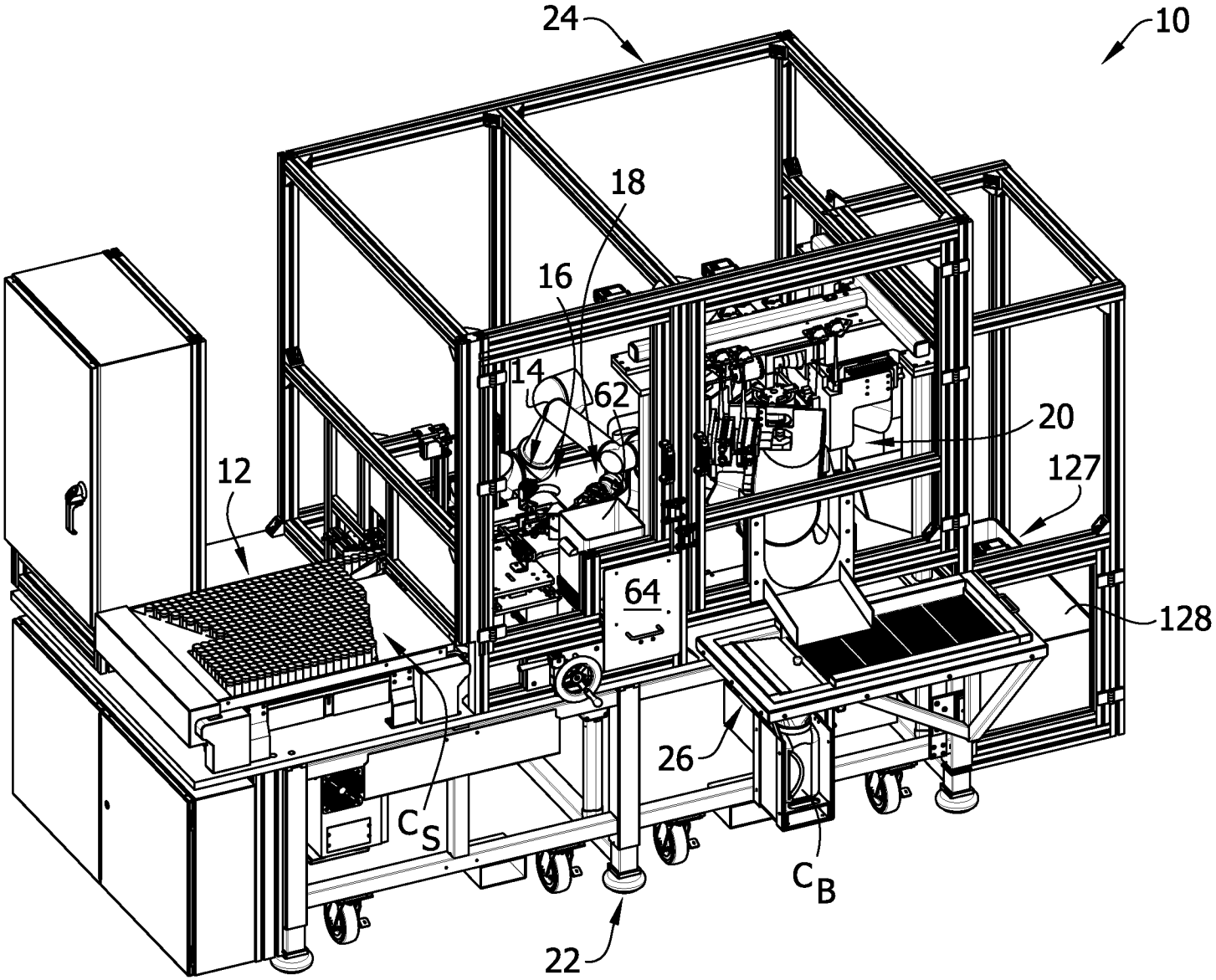
FIG. 1 is a perspective of a pharmaceutical container processing system embodying aspects of the present disclosure.

Referring to the drawings, FIG. 1 illustrates a pharmaceutical container processing system embodying aspects of the present disclosure, indicated generally by reference numeral 10. The pharmaceutical container processing system (e.g., a container disassembly workstation) 10 is used in a pharmaceutical order processing system, such as a high volume pharmaceutical order processing system, to facilitate the fulfillment of a prescription order received by the pharmaceutical order processing system. The prescription order may include one or more pharmaceuticals (e.g., prescription drugs). Pharmaceutical order processing systems typically involve processes to remove pharmaceuticals P (FIG. 9) from the manufacturer's packaging, transfer the pharmaceuticals to bulk storage containers, retrieve the pharmaceuticals from the bulk storage containers and fill and package the various pharmacy orders. The pharmaceutical container processing system 10 disclosed herein is used in a pharmaceutical order processing system to remove the pharmaceuticals P from the manufacturer's packaging and transfer the pharmaceuticals to bulk storage containers. After the pharmaceuticals P are transferred to the bulk storage containers, the bulk storage containers are transported to other components of the pharmaceutical order processing system where the pharmaceuticals can be used to fill pharmacy orders. Further details on pharmaceutical order processing systems and components thereof may be found in U.S. patent application Ser. No. 15/996,909 and U.S. patent application Ser. No. 16/226,944, the entireties of which are hereby incorporated by reference. However, it will be appreciated that the systems and components disclosed herein can be used in other contexts without departing from the scope of the present disclosure.

The pharmaceutical container processing system 10 is configured to "bulk-up" pharmaceuticals P for filling orders in the pharmaceutical order processing system. Generally speaking, "bulking-up" includes transferring the pharmaceuticals P contained by a plurality of containers (which may be the same or different sizes) into a single bulk container to be used with subsequent components of the pharmaceutical order processing system. Specifically, the pharmaceutical container processing system 10 transfers the pharmaceuticals P contained within relatively small volume containers $C_S$ into relatively large volume bulk containers $C_B$. The bulk container $C_B$ can be ten or more times larger than the small volume container, e.g., about a liter in size. In other words, the pharmaceutical container processing system 10 removes the pharmaceuticals P from the small containers $C_S$ in order to move the pharmaceuticals into the bulk container $C_B$.

The pharmaceutical container processing system 10 includes a hopper, generally indicated by reference numeral 12, a singulator assembly, generally indicated by reference numeral 14, an identification system, generally indicated by reference numeral 16, a container transporter, generally indicated by reference numeral 18, and a pharmaceutical extractor, generally indicated by reference numeral 20. The pharmaceutical container processing system 10 includes a frame 22 supporting the various components of the system. An enclosure or cover assembly 24 is attached to the frame 22 and covers at least the singulator assembly 14, the identification system 16, the container transporter 18 and the pharmaceutical extractor 18 to protect operators from being exposed to the pharmaceuticals P as the pharmaceuticals are transferred from the small containers $C_S$ to the bulk container $C_B$. In various drawings herein, the cover assembly 24 is removed to more clearly show other components. Desirably, the cover assembly 24 is transparent to permit the operator to view the operation of the pharmaceutical container processing system 10. Other configurations of the pharmaceutical container processing system 10 are within the scope of the present disclosure. Moreover, the pharmaceutical container processing system 10 may not include all of the above listed components or additional components. For example, in the illustrated embodiment, the pharmaceutical container processing system 10 also includes a pharmaceutical collector, generally indicated by reference numeral 26, for loading the pharmaceuticals P into the bulk container CB, as will be explained in more detail below.

Figure 2:
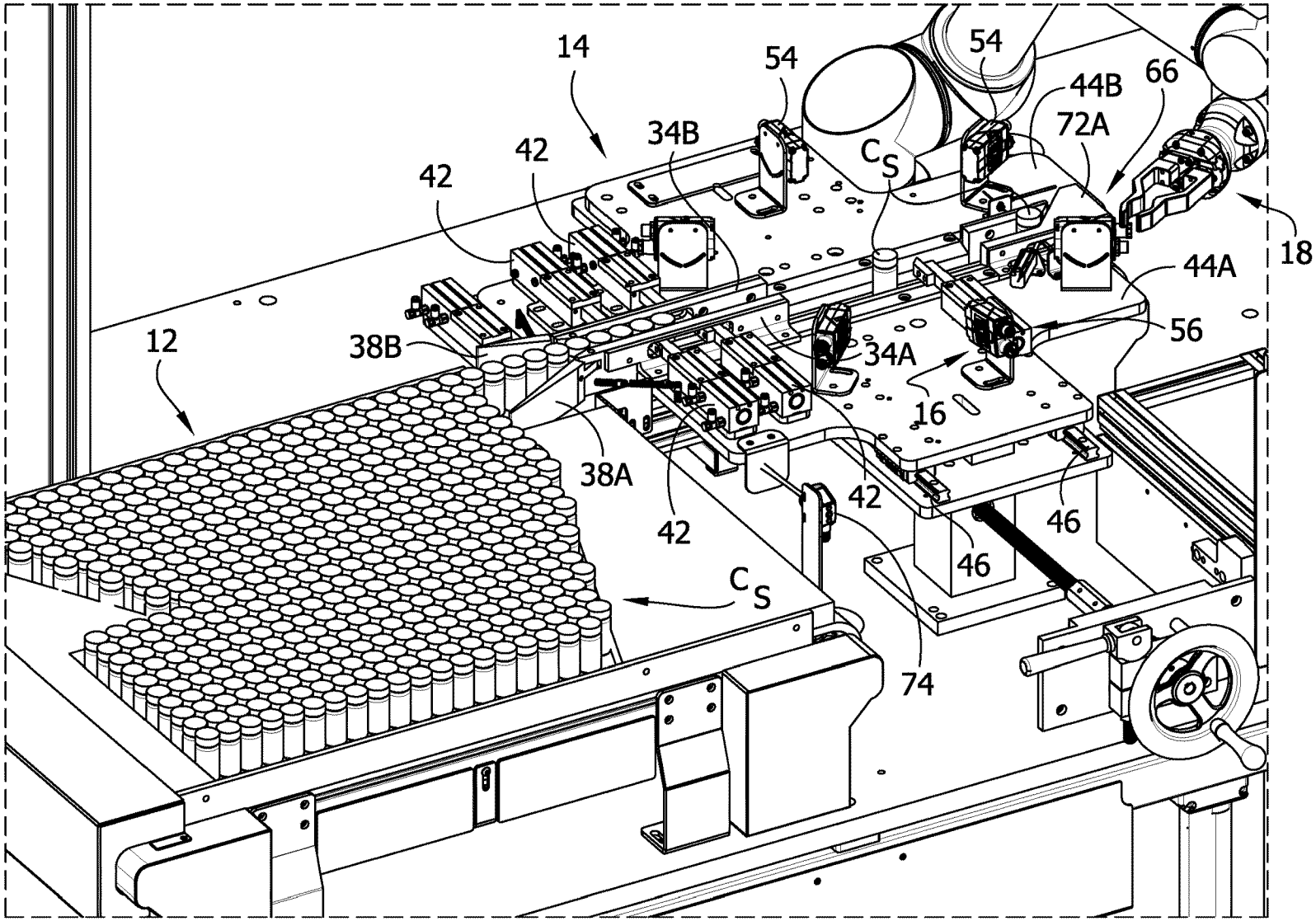
FIG. 2 is an enlarged, fragmentary perspective of a hopper and singulator assembly of the pharmaceutical container processing system of FIG. 1.
Figure 3:
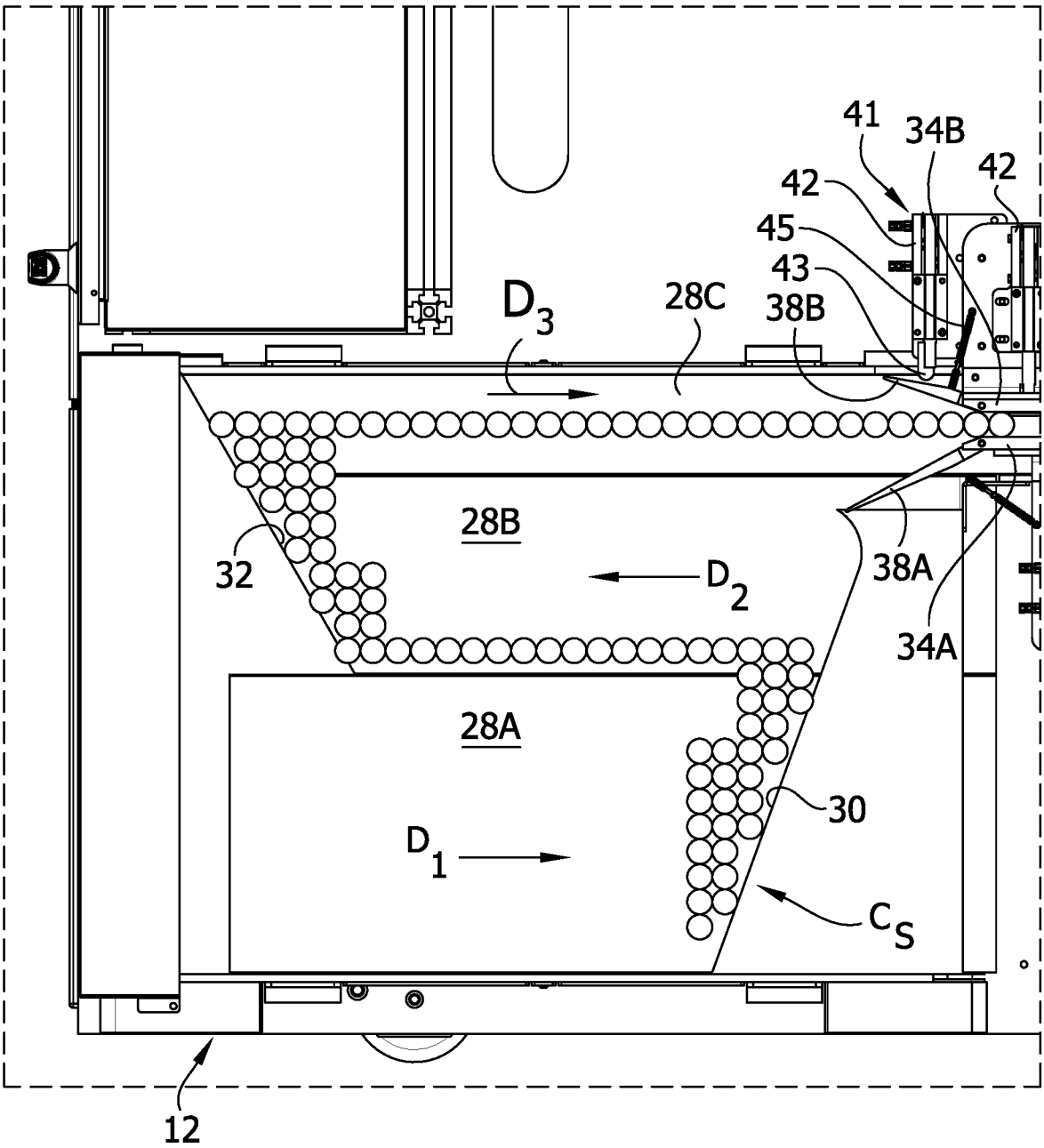
FIG. 3 is an enlarged, fragmentary top view of the hopper of FIG. 2.

Referring to FIGS. 1-4, the hopper 12 is configured to hold many (e.g., a plurality of) containers, such as the small containers $C_S$, and to dispense the containers from the hopper. For example, the hopper 12 may be configured to hold hundreds of small containers $C_S$. Operators place the containers $C_S$ in or on the hopper 12, where the containers are held and stored until the containers are moved (e.g., dispensed) to other components of the pharmaceutical container processing system 10. In the illustrated embodiment, the hopper 12 holds small containers $C_S$, although it is understood the hopper may hold containers of generally any size. In the illustrated embodiment, the hopper 12 includes three (broadly, at least two) conveyors, 28A, 28B and 28C, respectively, that move the containers $C_S$. The conveyors 28A-C are disposed side-by-side and receive the containers $C_S$ thereon. The conveyors 28A, 28C move in a generally opposite direction relative to conveyor 28B. As shown in FIG. 3, conveyors 28A and 28C move in first and third directions $D_1$, $D_3$, respectively, and conveyor 28B moves in a second direction $D_2$ generally opposite the first and third direction. The first and third directions $D_1$, $D_3$ are generally parallel to one another. Accordingly, in the illustrated embodiment, the hopper 12 is a bi-directional conveyor. The conveyors 28A-C are each driven by a prime mover, such as an electric motor (not shown), controlled by a control system 200 (FIG. 10) of the pharmaceutical container processing system 10. When needed, each prime mover can reverse the direction of each conveyor 28A-C to re-organize the containers to remove or reduce the possibility of a blockage that prevents the containers $C_S$ from moving on the first conveyor to the singulator assembly 14.

The hopper 12 is configured to move the containers $C_S$ placed thereon to the third conveyor 28C. The third conveyor 28C then moves the containers $C_S$ to the other components of the pharmaceutical container processing system 10, as described below. The hopper 12 includes a first angled ramp 30 overlying the first conveyor 28A. The first ramp 30 is angled in the sense that the first ramp extends at a non-orthogonal and non-parallel angle relative to the first direction $D_1$. As the first conveyor 28A moves in the first direction $D_1$, the containers $C_S$ are moved into contact with the first ramp 30 and move along the first ramp, as the first conveyor continues to move, onto the second conveyor 28B. The hopper 12 also includes a second angled ramp 32 overlying the second conveyor 28B. The second ramp 32 is angled in the sense that the second ramp extends at a non-orthogonal and non-parallel angle relative to the second direction $D_2$. As the second conveyor 28B moves in the second direction $D_2$, the containers $C_S$ are moved into contact with the second ramp 32 and move along the second ramp, as the second conveyor continues to move, onto the third conveyor 28C. In this manner, the hopper 12 generally moves the containers $C_S$ in a direction generally perpendicular to the third direction $D_3$ and onto the third conveyor 28C. Preferably, the conveyors 28A-C and ramps 30, 32 are configured such that the containers $C_S$ move onto the third conveyor at generally one end thereof.

Referring to FIGS. 1-5, the third conveyor 28C of the hopper 12 moves the containers $C_S$ to the singulator assembly 14. In particular, the third conveyor 28C extends generally along the singulator assembly 14 and moves the containers $C_S$along and through the singulator assembly. The singulator assembly 14 is configured to singulate the containers $C_S$ (e.g., separate or individualize each container from the other containers) as the containers are dispensed from the hopper 12. The singulator assembly 14 includes first and second rails 34A, 34B, respectively, defining a channel 36 through which the containers $C_S$ move as the containers are moved by the third conveyor 28C. First and second ramps or guides 38A, 38B extend from the proximal end of each respective rail 34A, 34B to guide the containers $C_S$ into the channel 36. The containers $C_S$ extend in a single file line between the rails 34A, 34B.

The singulator assembly 14 includes at least one crowder or stop 40A, 40B to singulate the containers $C_S$. Each stop 40A, 40B is configured to contact or engage one container $C_S$ as the containers are moved by the third conveyor 28C to inhibit the containers from moving with the third conveyor. Each stop 40A, 40B extends into the channel 36 to contact a lead container $C_S$ to inhibit the lead container, and any containers behind it, from moving with the third conveyor belt 28C. Each stop 40A, 40B is selectively retractable to singulate the lead container $C_S$ from the other containers by permitting the lead container to move with the third conveyor 28C. Each stop 40B is operatively coupled to an actuator 42 (e.g., linear actuator) which can move the stop between an extended position and a retracted position. In the extended position, each stop 40A, extends into (e.g., blocks) the channel 36 and inhibits containers $C_S$ from moving through the channel. In the illustrated embodiment, the stops 40A, 40B extend through openings in the rails 34A, 34B. In the retracted position, each stop 40A, 40B does not obstruct the channel 36 and the containers $C_S$ are free to move through the channel. Preferably, there are at least two stops, spaced longitudinally along the channel 36 such that the first stop 40A engages the lead container $C_S$ and the second stop 40B engages the container immediately behind the lead container so that when the first stop is retracted and permits the lead container to move with the third conveyor 28C, the second stop inhibits the other containers from moving with the third conveyor. In this configuration, once the lead container $C_S$ moves on, the first stop 40A returns to the extended position and the second stop 40B retracts to permit the line of containers to move up to the first stop. Once the new lead container $C_S$ engages the first stop 40A and inhibits the containers from moving any further, the second stop 40B is moved back into the extended position and the cycle repeats. In the illustrated embodiment, the singulator assembly 14 includes four stops with two stops 40A, 40B shown in the extended position and two stops shown in the retracted position and hidden from view. The additional stops enable the singulator assembly 14 to use any two stops to singulate containers of other sizes. In one embodiment, the singulator assembly 14 also includes a dislodging assembly 41 operatively coupled to at least one of the ramps 38A, 38B to move the ramps (e.g., the ramps are movable or pivotable) to break-up the containers $C_S$ in the event they become lodged while moving into the channel 36 and transitioning into a single file line. In the illustrated embodiment, the dislodging assembly 41 includes an actuator 42 operatively coupled to a bumper 43. The actuator 42 is configured to selectively move the bumper in and out to push and move (e.g., rotate) the ramp 38B to dislodge the containers $C_S$. A spring 45 biases the ramp 38B in the position shown in FIGS. 3 and 4 such that the ramp returns to this original position when the bumper 43 does not engage and push the ramp. Other configurations of the singulator assembly 14 are within the scope of the present disclosure.

The singulator assembly 14 is selectively adjustable to enable the singulator assembly to singulate different sizes of containers. The singulator assembly 14 includes first and second movable platforms 44A and 44B, respectively. The first rail 34A, first stop 40A and corresponding actuator 42 are mounted on the first movable platform 44A and the second rail 34B, second stop 40A and corresponding actuator are mounted on the second movable platform 44B. The first and second movable platforms 44A, 44B (broadly, the first and second rails 34A, 34B) move toward or away from one another (e.g., in a direction generally perpendicular the third direction $D_3$) to change the distance between the rails 34A, 34B, and thereby the width of the channel 36, to configure the singulator assembly 14 for different sizes of containers. Each movable platform 44A, 44B is movably mounted on rails or tracks 46. The singulator assembly 14 includes a drive or adjustment assembly 48 operatively coupled to the first and second movable platforms 44A, 44B (broadly, the first and second rails 34A, 34B) to move the platforms toward or away from one another. The adjustment assembly 48 includes a handle 50 coupled to and configured to rotate a threaded shaft 52. The first and second movable platforms 44A, 44B are threadably connected to the threaded shaft 52. As the handle 50 turns the threaded shaft 52, the threaded shaft rotates and moves the first and second movable platforms 44A, 44B along the tacks 46. The threaded shaft 52 includes oppositely oriented first and second threads along its length. The first threads engage the first movable platform 44A and the second threads engage the second platform 44B so that the platforms move either toward or away from one another as the threaded shaft 52 rotates (either clockwise or counter-clockwise). In an example embodiment, the singulator assembly 14 (specifically, the movable platforms 44A, 44B) can be automatically adjusted based on the size, e.g., diameter or maximum horizontal dimension, of the containers $C_S$. The size of the containers $C_S$ can be entered into the control system 200 or sensed by pressure sensors (not shown) connected the control system and mounted on the first and second movable platforms 44A, 44B. The size of the containers $C_S$ can be sensed using non-contact sensor, e.g., light, LED, or the like sensors. The control system 200 can activate a prime mover, such as an electric motor (not shown), operatively coupled to the threaded shaft 52 to move the first and second movable platforms 44A, 44B to adjust the width the channel 36.

Figure 10:
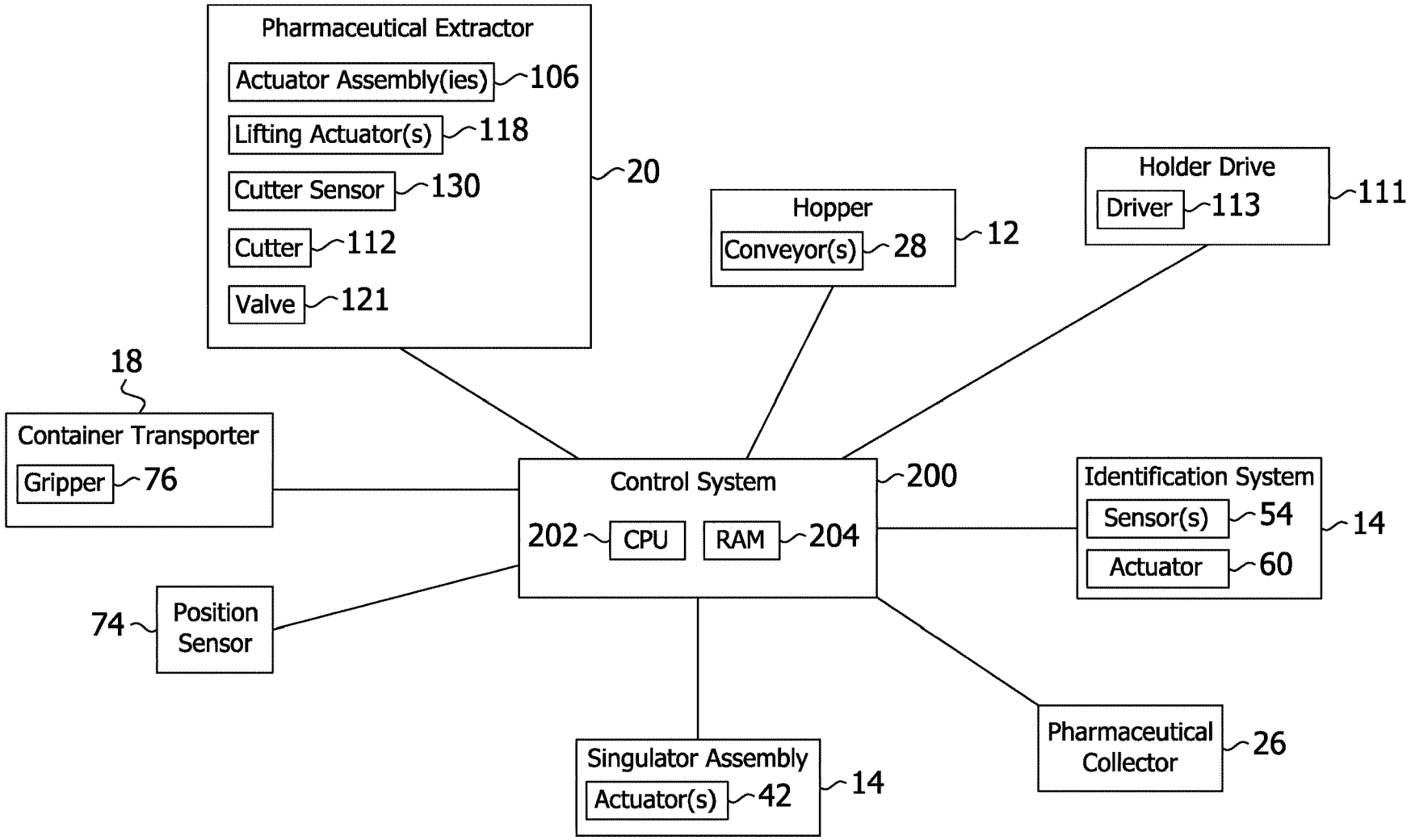
FIG. 10 is a diagram of an exemplary control system of the pharmaceutical container processing system.

Still referring to FIGS. 2-5, the identification system 16 of the pharmaceutical container processing system 10 is configured to identify the containers $C_S$. In particular, the identification system 16 is configured to identify the containers $C_S$ after the containers have been singulated by the singulator assembly 14. The identification system 16 includes at least one sensor 54 that reads or scans a machine readable marking (e.g., a barcode, QR code, etc.) on each container $C_S$. Each sensor 54 may be a camera, a light scanner or a laser scanner, such as a bar code reader. In one embodiment, each sensor 54 is a Cognex® Camera, although other suitable sensors or scanners (broadly, vision systems) are within the scope of the present disclosure. Each sensor 54 is in communication with (e.g., wired or wireless communication) with a processor (not shown). The processor may be part of the identification system 16 or some other component, such as the control system 200 (FIG. 10). The processor compares the identity of the container $C_S$, as read by the sensor 54, with a current work order to verify the container and the pharmaceuticals P contained therein are supposed to be included in the current work order. For example, in one embodiment, each container $C_S$ may be pre-scanned before being placed in the hopper 12 and then identified and validated by the identification system 16 by comparing the identity read by the sensor 54 with the pre-scan. If the container $C_S$ is verified by the identification system 16, the container transporter 18 will move the verified container to the pharmaceutical extractor 20, as described in more detail below. If the container $C_S$ is not verified or unable to be read by the sensor 54, the container transporter 18 will move the unverified container to a reject bin 62 (FIG. 1) which is accessible to the operator through a door 64 in the cover assembly 24.

In the illustrated embodiment, the identification system 16 includes six sensors 54. The sensors 54 are arranged (e.g., in a circular configuration) to surround a sensing location on the third conveyor belt 28C. As a container $C_S$ leaves the singulator assembly 14, the container moves through the sensing location past the sensors 54. The machine readable marking on each container $C_S$ may be in a horizontal or vertical orientation on the container and can be at generally any location on the surface of the container. Having six sensors 54 that each scan different sides of the container $C_S$ ensures that at least one sensor will be able to see and read the machine readable marking on the container. Other arraignments and/or configurations of the sensors 54 are within the scope of the present disclosure. For example, one or more additional sensors 54 may be added at any position along the conveyor 28C (e.g., either upstream or downstream). The identification system 16, optionally, may also include an orientation adjuster 56 to adjust the orientation of the container $C_S$ on the third conveyor 28C if the sensors 54 are unable to clearly see the machine readable marking. The orientation adjuster 56 includes a stop 58 and an actuator 60, similar to stops 40 and actuators 42. If the imagers 54 are unable to get a clear image of the machine readable marking, the orientation adjuster 56 activates and the actuator 60 pushes the stop 58 into the path of the container $C_S$. The container $C_S$ hits the stop 60 and, due to the continued movement of the third conveyor 28C, jostles or rotates on the conveyor to change the orientation of the container until one of the sensors 54 gets a clear image of the machine readable marking. After a clear image is obtained, or a set period of time passes (e.g., the imagers are unable to read the machine readable marking), the stop 60 retracts to permit the container $C_S$ to continue moving with the third conveyor 28C. Other configurations of the orientation adjuster 56 are within the scope of the present disclosure. For example, the orientation adjuster may rotate the container $C_S$ while container is being scanned.

Figure 4:
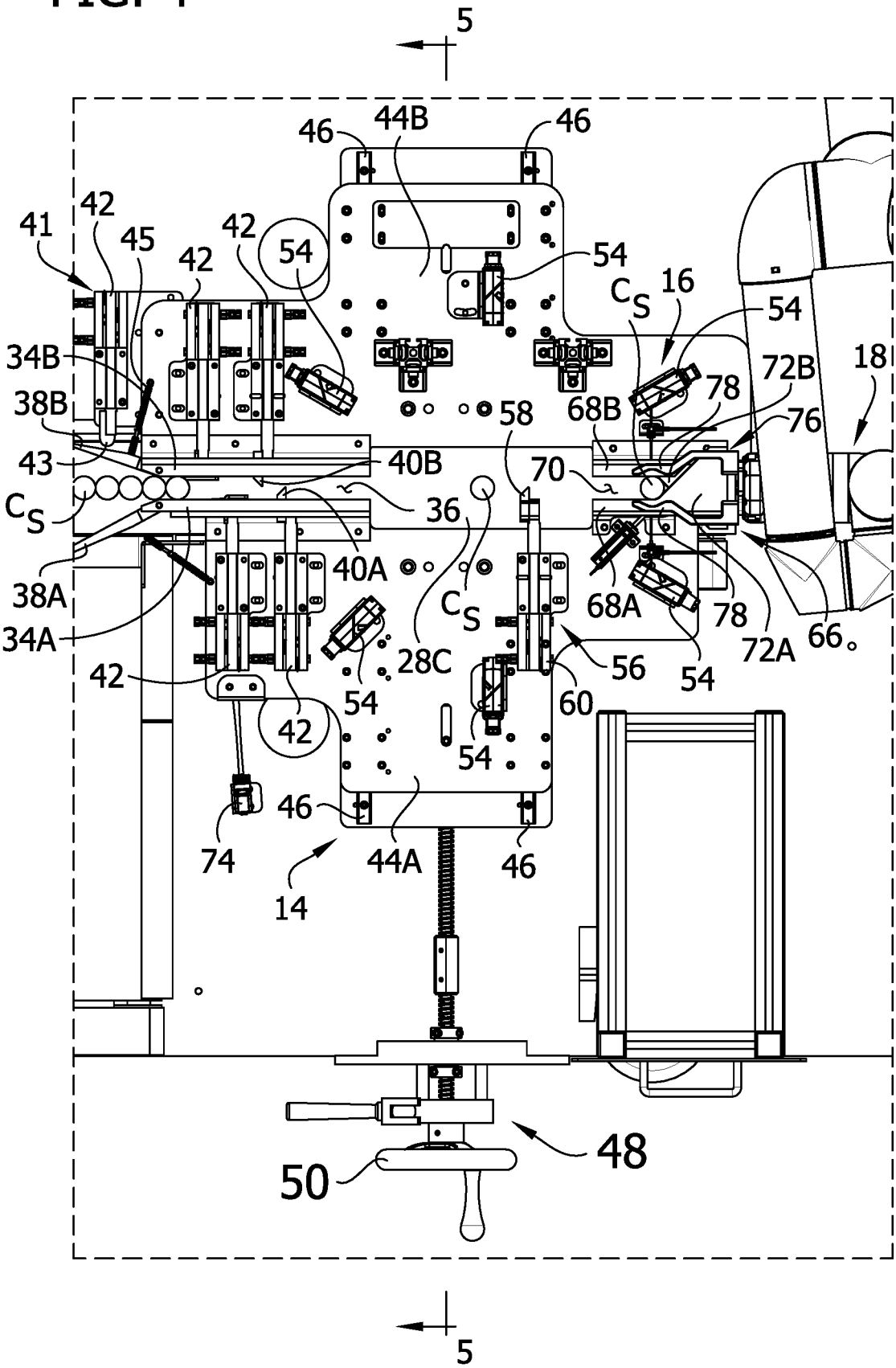
FIG. 4, is an enlarged, fragmentary top view of the singulator assembly of FIG. 2.
Figure 5:
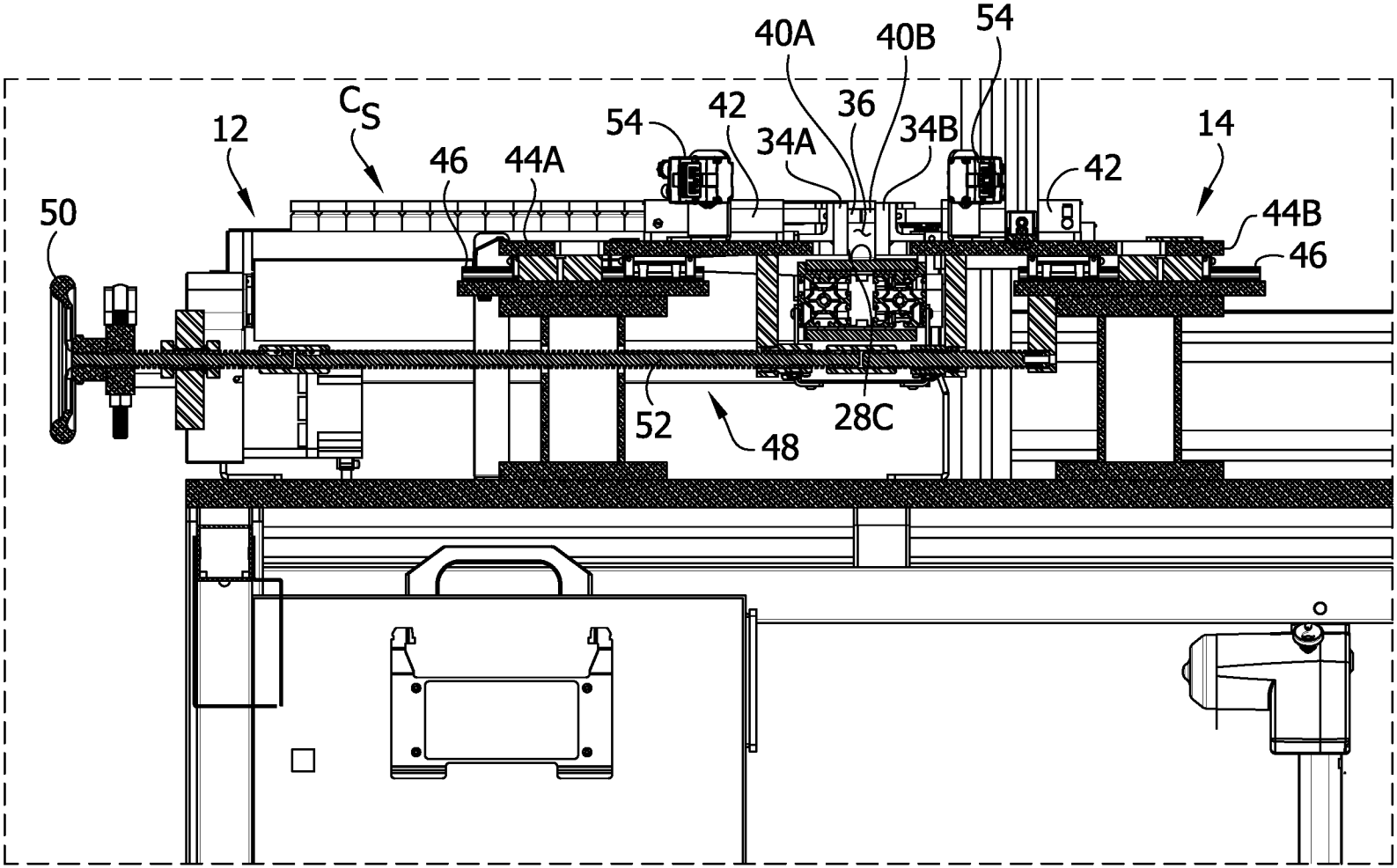
FIG. 5 is a section of the pharmaceutical container processing system taken in a plane including line 5-5 of FIG. 4.

Still referring to FIGS. 2-4, a stop assembly 66, which may broadly be considered part of the singulator assembly 14, is disposed at the end of the third conveyor 28C. The stop assembly 66 receives the containers $C_S$, after they have been singulated and verified, and holds the containers in position (e.g., at a pickup location) to be picked up by the container transporter 18. The stop assembly 66 includes first and second rails 68A and 68B, respectively, defining a channel there between that receives the container $C_S$. The end of the channel 70 is closed to prevent the container $C_S$ from continuing to move with the third conveyor 28C. The end of the channel 70 tapers and is generally V-shaped and is defined by first and second angled plates 72A, 72B that overlap one another. Each plate 72A, 72B defines one side of the V-shaped end of the channel 70. The first rail 68A and first plate 72A are mounted on the first platform 44A and the second rail 68B and second plate 72B are mounted on the second platform 44B. Accordingly, the rails 68A, 68B and plates 72A, 72B move away or toward one another as the platforms 44A, 44B are moved toward or way from one another to adjust the singulator assembly 14 to fit containers of various sizes. This also allows the stop assembly 60 to be adjusted to fit containers of various sizes. The end of the channel 70 is V-shaped in order to orient square shapes containers (not shown) so that the container is cut on a leading edge or corner, as will become apparent after the cutting of the container is explained below.

When moved to adjust the stop assembly 66 to containers of other sizes, the angled plates 72A, 72B move relative to one another and change the size of the V-shaped end of the channel 70. Accordingly, the exact pickup location where the container $C_S$ is stopped by the angled plates 72A, 72B and is picked up by the container transporter 18 changes as the width of the channels 36, 70 are adjusted to for different sizes of containers. A position sensor 74 determines the position of the first and second movable platforms 44A, 44B. The exact pickup location where the container $C_S$ is stopped by the angled plates 72A, 72B is a function of the location of the first and second movable platforms 44A, 44B. By determining the position of the first and second movable platforms 44A, 44B the pickup location can be determined. This information is used by the container transporter 18 to position the transporter in the correct position to pick up the container $C_S$ from the pickup location. The position sensor 74 is in communication with the container transporter 18 via a processor, which may be part of the control system 200. The processor receives the information provided by the position sensor 74 and determines the pickup location, based on the received information, and relays the pickup location to the container transporter 18. In the illustrated embodiment, the position sensor 74 is a distance sensor configured to measure the distance between itself and a portion of the first movable platform 44A. Other configurations of the stop assembly 66 are within the scope of the present disclosure.

Referring to FIGS. 2-4 and 6, the container transporter 18 is configured to move the containers $C_S$ to the pharmaceutical extractor 20. In particular, the container transporter 18 is configured to pick up the container $C_S$ from the pickup location defined by the stop assembly 66 and move the container to the pharmaceutical extractor 20. In the illustrated embodiment, the container transporter 18 is a robot such as a six-axis robotic arm, a selective-compliance-articulated robotic arm, a cylindrical robot, a delta robot, a polar coordinate robot, a vertically articulated robot, a Cartesian coordinate robot or any other suitable device. The container transporter 18 includes a gripper 76 configured to selectively grab the container $C_S$. In the illustrated embodiment, the gripper 76 includes two selectively movable jaws 78, although other configurations are within the scope of the present disclosure. As mentioned above, if the container $C_S$ grabbed by the container transporter 18 is verified by the identification system 16, the container transporter moves the container to the pharmaceutical extractor 20. However, if the container $C_S$ is not verified or is unable to be read by the identification system 16, the container transporter moves the unverified container to the reject bin 62.

Referring to FIGS. 6-9, the pharmaceutical extractor 20 is configured to remove the pharmaceuticals P from the containers $C_S$. The pharmaceutical extractor 20 includes a plurality of holders 100A-C, each holder configured to hold a container $C_S$ (broadly, at least one container). Specifically, each holder 100A-C includes a gripper 102 configured to hold one container $C_S$. Each gripper 102 is configured to selectively grab, retain and release the container $C_S$. In the illustrated embodiment the gripper 102 includes two selectively movable jaws 104, although other configurations are within the scope of the present disclosure. Each holder 100A-C includes an actuator assembly 106, including one or more actuators (such as but not limited to one or more linear actuators and/or rotary actuators) to open and close the gripper 102 (e.g., move the jaws 104) to selectively grab and release the container $C_S$. The actuator assembly 106 can also rotate the gripper 102 and shake the gripper, as discussed in more detail below. In addition, each holder 100A-C includes a discharge chute 108 disposed below the gripper 102 and configured to catch and guide the pharmaceuticals P contained in each container $C_S$ and the container or portions thereof to other components of the pharmaceutical container processing system 10, as described in more detail below. In the illustrated embodiment, the pharmaceutical extractor 20 includes three holders 100A-C (e.g., a first holder, a second holder and a third holder), although more or fewer holders are within the scope of the present disclosure.

Each holder 100A-C is configured to move between a plurality of different stations or locations (e.g., container operation locations) of the pharmaceutical extractor 20. At each location, a different operation or operations (e.g., container operations) occurs in the process of removing the pharmaceuticals P from the container $C_S$. The plurality of locations are arranged in a series (e.g., a series of locations) along which the pharmaceutical extractor 20 is configured to perform a series of operations. Thus, the pharmaceutical extractor 20 is a progressive, multi-stage disassembly device that moves each holder 100A-C and container $C_S$ held thereby through the different steps for removing the pharmaceuticals P from the container, as described in more detail below. In the illustrated embodiment, the pharmaceutical extractor 20 includes three locations (e.g., a first location, a second location and a third location) for each holder 100A-C to move to, although more or fewer locations are within the scope of the presented disclosure.

The holders 100A-C are configured to cycle through the three locations in series. As explained in more detail below, the pharmaceutical extractor 20 moves the holders 100A-C, one holder after another holder, along the series of locations to extract the pharmaceuticals P from the containers $C_S$. In this embodiment, the holders 100A-C cycle through the series of locations by rotating through the three locations. Moreover, as will become apparent, the pharmaceutical extractor 20 repeatedly cycles the holders 100A-C through the series of locations to perform the series of operations on additional containers $C_S$, to extract the pharmaceuticals P from the additional containers. Each holder 100A-C is mounted to a shaft 110 that defines an axis of rotation AR the shaft and holders rotate about. The shaft 110 is part of a holder drive 111 that rotates the holders 100A-C between the plurality of locations. The holder drive 111 includes a driver 113, such as an electric motor, operatively coupled to the shaft 110. The driver 113 is controlled by the control system 200 to selectively rotate the shaft 110, and therefore the holders 100A-C, between the locations in series. In this embodiment, the holder drives 111 moves the holders between the locations at generally the same time. Each location and holder 100A-C are evenly spaced apart (radially) about the axis of rotation AR (e.g., the holders are radially spaced apart by about 120 degrees). Accordingly, the shaft 110 rotates about 120 degree at a time in order to move the holders 100A-C to the different locations. As shown in FIGS. 6-9, the first holder 100A is disposed in the first location, the second holder 100B is disposed in the second location and the third holder 100C is in the third location. Each holder 100A-C moves, in order, from the first location, to the second location, to the third location and then back to the first location to repeat the cycle. For example, when the holders 100A-C are moved (e.g., rotated approximately 120 degrees) to the next location from their locations shown in FIGS. 6-9, the first holder 100A will be disposed in the second location, the second holder 100B is disposed in the third location and the third holder 100C is disposed in the first location. As will become apparent, the first location may be considered a pickup/drop-off location, the second location may be considered a cutting location, and the third location may be considered a pharmaceutical unloading location. It will be appreciated that holder drives having other configurations or arrangements could be used without departing from the scope of the presented disclosure. For example, the holder drive could include a plurality of discrete robotic arms associated with individual or multiple holders for driving the movement of the holders.

Figure 6:
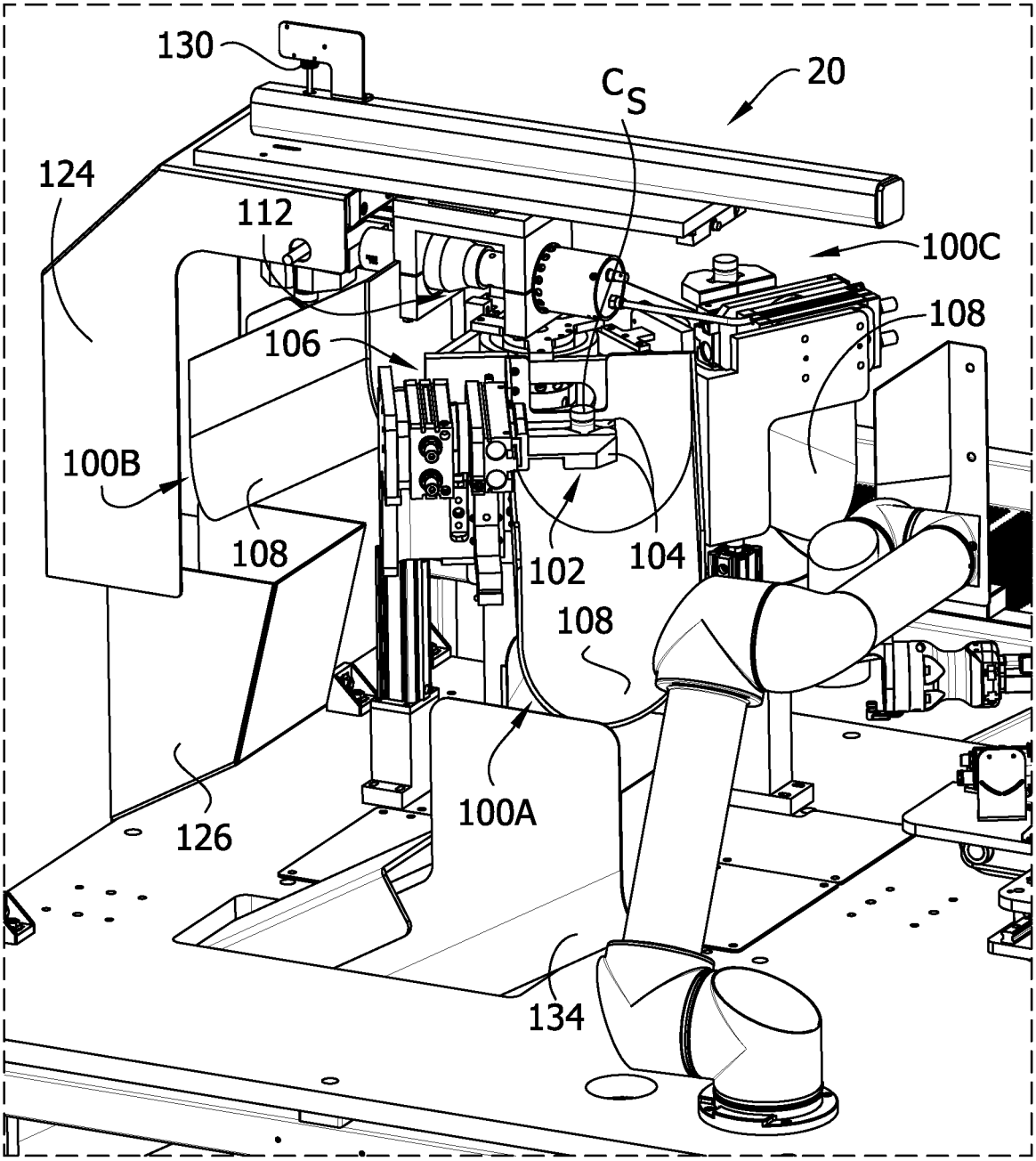
FIG. 6 is an enlarged, fragmentary perspective of a first container operation location of a pharmaceutical extractor of the pharmaceutical container processing system of FIG. 1.

Referring to FIG. 6, each holder 100A-C is configured to receive one of the containers $C_S$. In particular, the gripper 102 of each holder 100A-C receives the container $C_S$ when each holder is at the first location. The container transporter 18 moves the container $C_S$ from the pickup location defined by the stop assembly 66 and delivers the container to the holder 100A-C at the first location. The container transporter 18 positions the container $C_S$ in a position such that when the gripper 102 of the holder 100A-C at the first location closes, the gripper holds and retains the container. After the gripper 102 of the holder 100A-C secures the container $C_S$, the container transporter 18 releases its hold on the container and moves back to the pickup location to grab another container to be delivered to another holder of the pharmaceutical extractor 20. Preferably, the gripper 102 inverts (e.g., flips over, rotates about 180 degrees) the container $C_S$ so that the bottom of the container is facing upwards, as shown in FIG. 6. As mentioned above, the actuator assembly 106 includes a rotary actuator to rotate the gripper 102 and invert the container $C_S$. In other embodiments, the container transporter 18 may invert the container $C_S$ as the container transporter delivers the container to the holder 100A-C at the first location. Once the container $C_S$ is secured in the holder 100A-C, the holder is moved to the second location.

Figure 7:
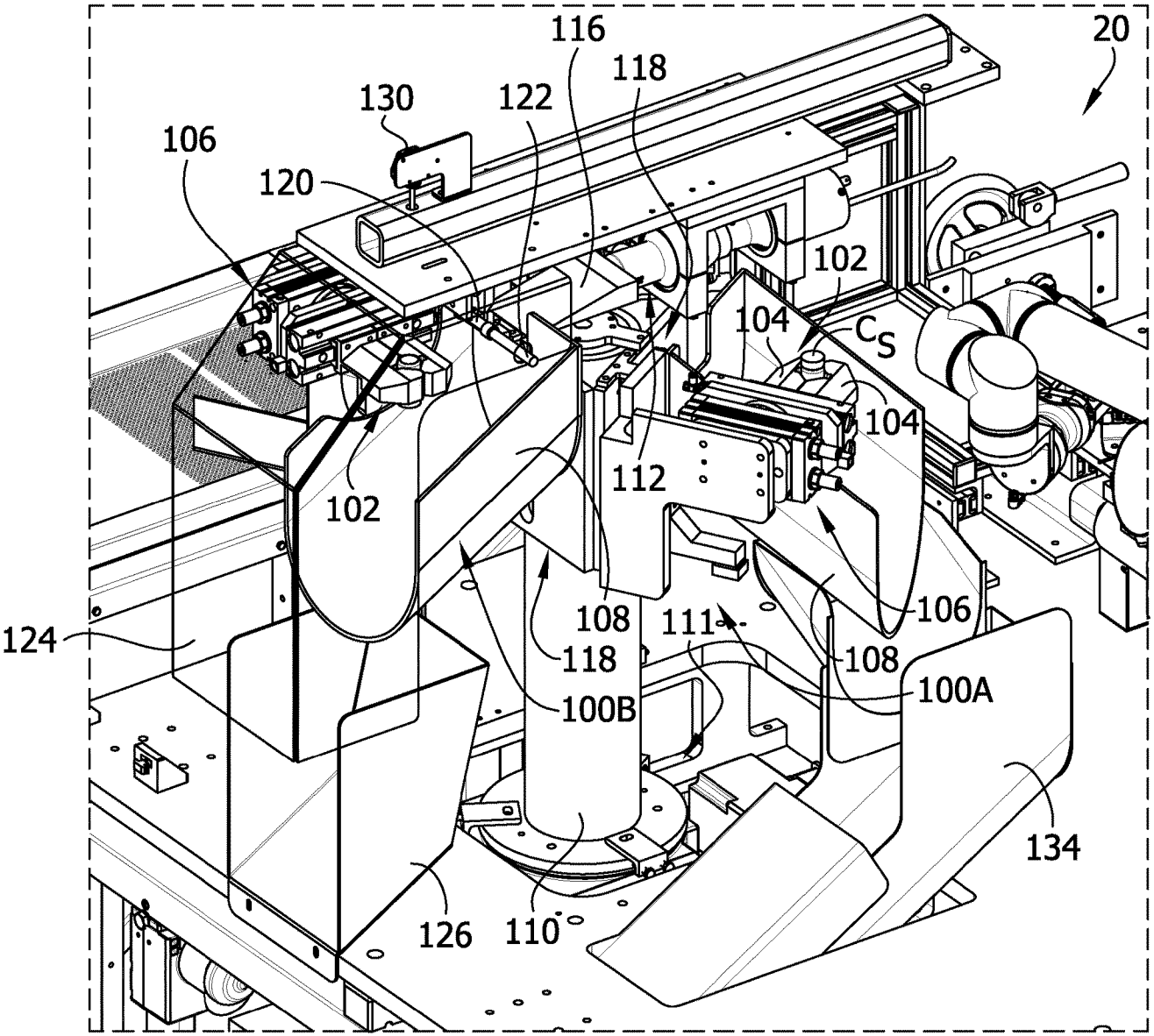
FIG. 7 is an enlarged, fragmentary perspective of a second container operation location of the pharmaceutical extractor of FIG. 5, with a shroud of the pharmaceutical container processing system shown as being transparent to show components behind the shroud.
Figure 8:
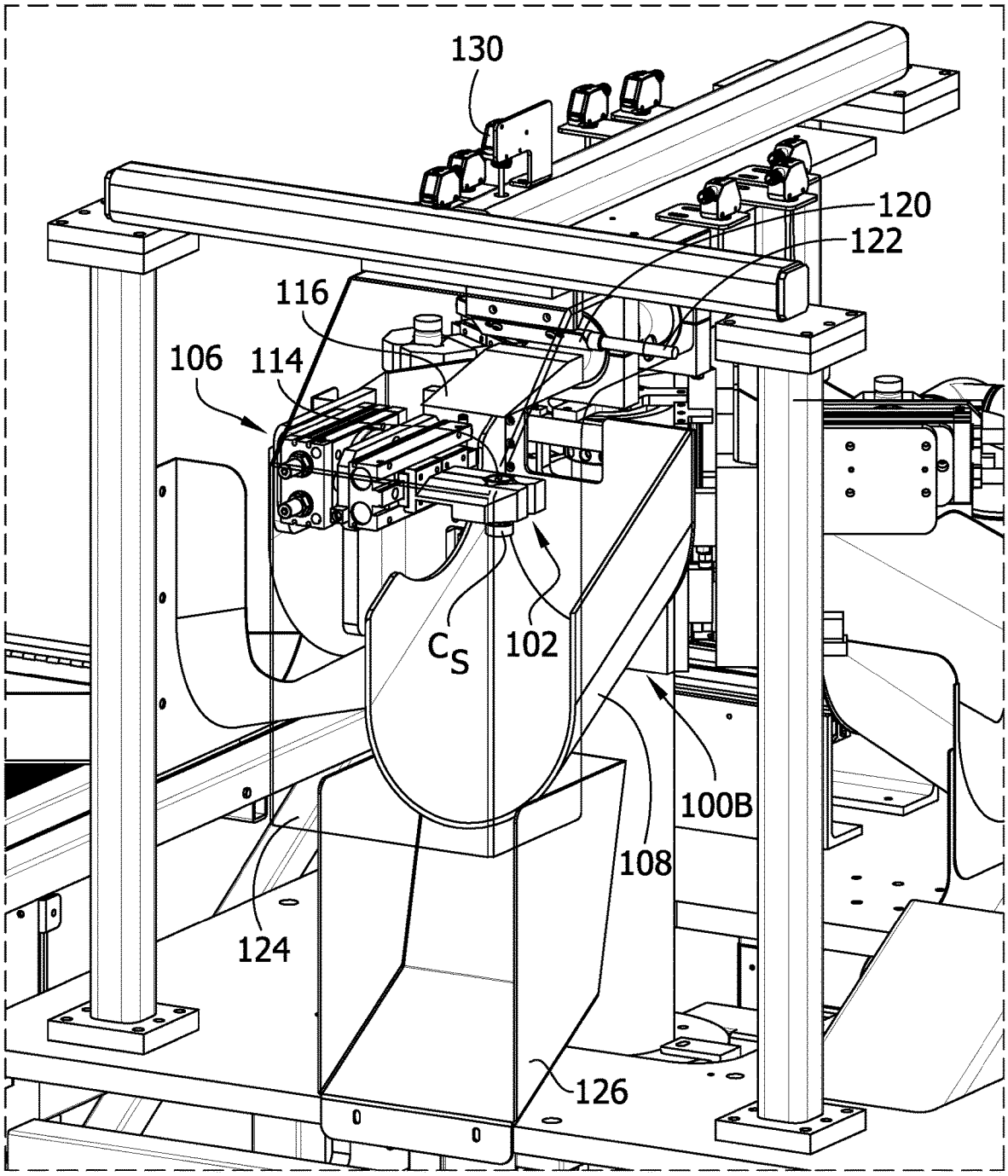
FIG. 8 is a view similar to FIG. 6 but shows a container after the a pharmaceutical opening has been cut therein.

Referring to FIGS. 7 and 8, the pharmaceutical extractor 20 includes a cutter 112 located along the series of locations. Specifically, the cutter 112 is disposed at the second location. The cutter 112 is configured to cut the container $C_S$ held by the gripper 102 of the holder 100A-C to create a pharmaceutical opening or outlet 114 in the container. Specifically, the cutter 112 creates the pharmaceutical outlet 114 in the container $C_S$ when the container and corresponding holder 100A-C holding the container are at the second location. In the illustrated embodiment, the cutter 112 cuts off a bottom portion of the container $C_S$ (which is facing upwards) to form the pharmaceutical outlet 114. In the illustrated embodiment, the cutter 112 is an ultrasonic cutter that vibrates a horn or blade 116 to cut the container $C_S$. The cutter 112 is configured to move the blade 116 toward and through the container $C_S$ (e.g., move generally radially outward from the axis of rotation AR). Each holder 100A-C is configured to lift the container $C_S$ upward. By moving the container $C_S$ upward, the holder 100A-C places the container to the path of the blade 116 so that as the blade is advanced, the blade cuts off the bottom portion of the container to form the pharmaceutical outlet 114. FIG. 7 shows the container $C_S$ in the lifted or raised position and FIG. 8 shows the container $C_S$ in the unlifted or lower position, after the pharmaceutical opening 114 has been formed. Each holder 100A-C includes a lifting actuator 118 (e.g., a linear actuator) operatively connected to and between the gripper 102 and the shaft 110 to move the container $C_s$ upward. In the illustrated embodiment, the lifting actuator 118 connects the holder 100A-C to the shaft 110, although other configurations are within the scope of the present disclosure. For example, the lifting actuator may be part of the actuator assembly 106. In addition, in the illustrated embodiment, the lifting actuator 118 also raises and lowers the discharge chute 108 as well. Preferably, the lifting actuator 118 raises and lowers the container $C_S$ when the holder and container are at the second location, although raising and lower the container at other times is within the scope of the present disclosure.

Still referring to FIGS. 6 and 7, the pharmaceutical extractor 20 includes a nozzle 120 configured to direct a stream of gas (e.g., air) onto the bottom portion of the container $C_S$ to push the bottom portion of the container off the remainder of the container. The nozzle 120 is fluidly connected to a pressure source (not shown), such as an air compressor, via a hose 122. A selectively actuatable valve 121 (FIG. 10) may be connected to the hose 122. The selectively actuatable valve 121 can be selectively opened and closed to only supply the stream of air after the blade 116 has cut the container $C_S$. The selectively actuatable valve 121 can be controlled by the control system 200. In one embodiment, an air ionizer (not shown) ionizes the stream of air before leaving the nozzle 120 to reduce static and dust. The pharmaceutical extractor 20 includes a shroud 124 configured to guide the bottom portion of the container $C_S$ to a waste chute 126 of a waste collector 127 after the bottom portion is blown off the container by the stream of gas from the nozzle 120. The shroud 124 generally surrounding at least a portion of the second location and acts as a backstop for the bottom portion of the container $C_S$. The nozzle 120 directs the stream of gas in a direction generally toward the shroud 124, blowing the bottom portion of the container $C_S$ into the shroud. The bottom portion is then directed downward, by gravity, into the waste chute 126. The waste chute 126 directs the bottom portion of the container $C_S$ into a waste bin 128 (FIG. 1) of the waste collector 127.

The pharmaceutical extractor 20 also includes a cutter sensor 130 at the second location to confirm the pharmaceutical outlet 114 is formed. Specifically, the cutter sensor 130 is used to confirm the bottom portion of the container $C_S$ has been removed. The cutter sensor 130 is in communication with a processor, such as the processor 202 of the control system 200, which receives the information provided by the sensor to determine if the bottom portion of the container $C_S$ has been removed. In one embodiment, the cutter sensor 130 is a distance sensor configured to measure the distance between itself and the bottom of the container $C_S$. When the measured distance changes due to the bottom portion being removed, the processor knows the bottom portion has been cut off the container and the pharmaceutical outlet 114 has been formed. If the processor determines the pharmaceutical outlet has not been formed (e.g., the bottom portion has not been removed) in the container $C_S$, the container is moved back to the first location, as described herein, where the processor instructs the container transporter 18 to grab and move the container to the reject bin 62. Once the pharmaceutical outlet 114 has been created in the container $C_S$, the container and holder 100A-C are moved to the third location.

Figure 9:
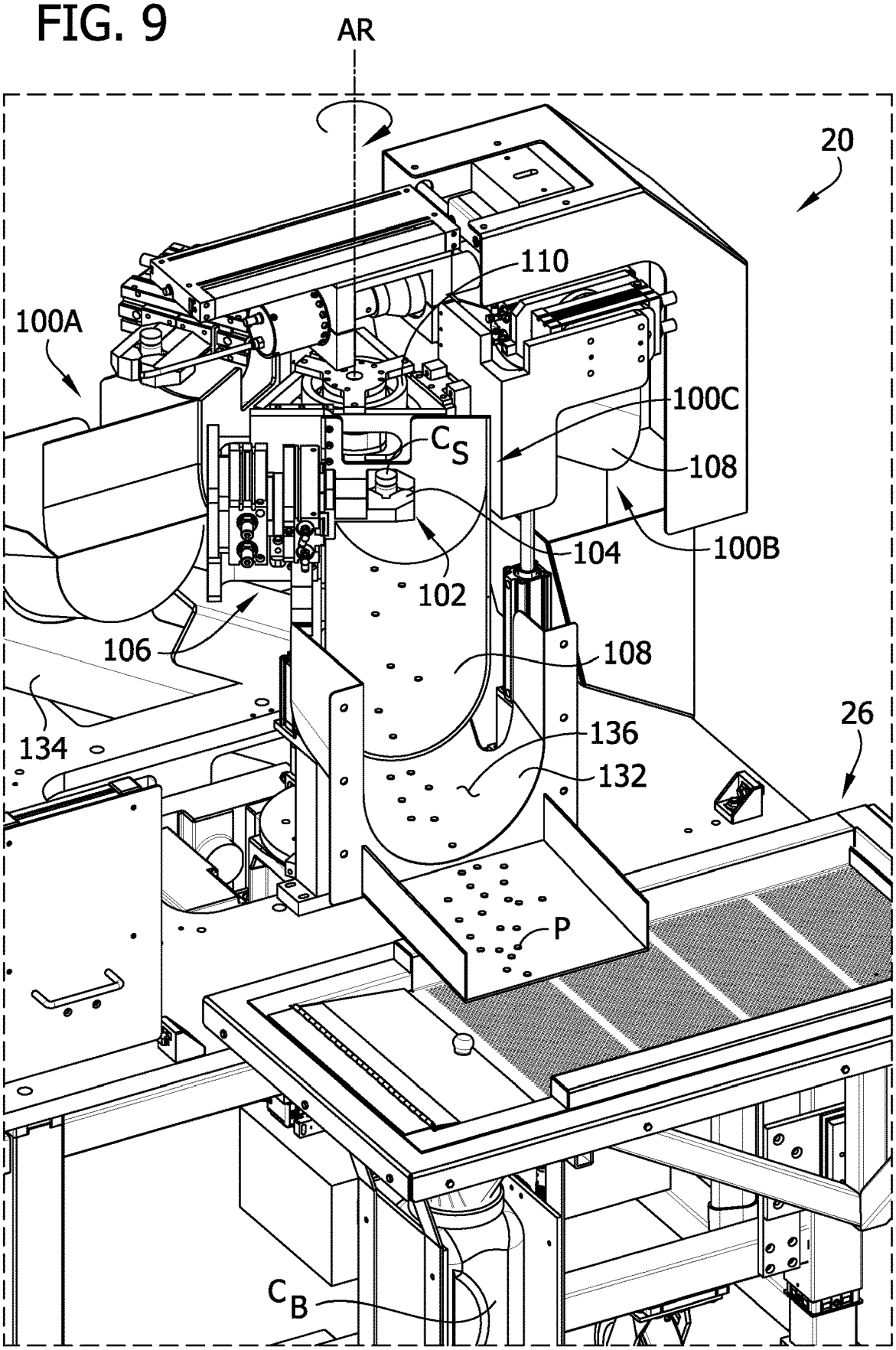
FIG. 9 is an enlarged, fragmentary perspective of a third container operation location of the pharmaceutical extractor of FIG. 5.

Referring to FIG. 9, the pharmaceutical extractor 20 includes a pharmaceutical collection inlet 136 located along the series of locations. Desirably, the pharmaceutical collection inlet 136 is located in the series of locations downstream from the cutter 112. In the illustrated embodiment, the pharmaceutical collection inlet 136 is disposed at the third location. The pharmaceutical collection inlet 136 is configured to receive the pharmaceuticals P from the pharmaceutical outlets 114 in the containers $C_S$. The pharmaceuticals P in the container $C_S$ move through the pharmaceutical outlet 114 and out of the container when the container is at the third location. Each holder 100A-C is configured to move the container $C_S$ so that the pharmaceuticals P in the container flow through the pharmaceutical outlet 114. In particular, the gripper 102 of each holder 100A-C moves the container $C_S$ from the inverted orientation (broadly, a first orientation) to an upright or non-inverted orientation (broadly, a second orientation). The gripper 102 is rotated by the actuator assembly 106 of the holder 100A-C. In the upright orientation, as shown in FIG. 9, the pharmaceuticals P, under the influence of gravity, move through pharmaceutical outlet 114, out of the container $C_S$ and into the pharmaceutical collection inlet 136. It is understood the gripper 102 may move the container $C_S$ into other orientations, besides the upright orientation, to enable the pharmaceuticals P to flow through the pharmaceutical outlet 114.

In the illustrated embodiment, the pharmaceutical extractor 20 includes a pharmaceutical chute 132 which defines the pharmaceutical collection inlet 136. When the pharmaceuticals P fall out of the container $C_S$, the pharmaceuticals fall into the pharmaceutical chute 132 (e.g., pharmaceutical collection inlet 136). The pharmaceutical chute 132 then directs the pharmaceuticals P to the pharmaceutical collector 26. Accordingly, the pharmaceutical collector 26 receives the pharmaceuticals P from the container $C_S$ disposed at the third location. The operator can then use to the pharmaceutical collector 26 to move the pharmaceuticals P into the bulk container $C_B$. The operator can shift through the pharmaceuticals P received by the pharmaceutical collector 26 to remove damaged or broken pharmaceuticals and other contaminants while additional pharmaceuticals are removed from the containers $C_S$. In some instances, the pharmaceuticals P may fall from the container $C_S$ onto the discharge chute 108, which then directs the pharmaceuticals to the pharmaceutical collection inlet 136 (e.g., onto the pharmaceutical chute 132). The pharmaceutical chute 132 may, broadly, be considered part of the pharmaceutical collector 26. The operator working at the pharmaceutical collector 26 may also be able to start/stop and/or slow down the system 10, via the control system 200, in order to shift through the pharmaceuticals at the operator's own pace. Further details on the pharmaceutical collector 26 are described in U.S. patent application Ser. No. 16/226,944, incorporated by reference above.

To further facilitate the movement (e.g., extraction) of the pharmaceuticals P through the pharmaceutical outlet 114, each holder 100A-C is configured to shake the gripper 102 and container $C_S$ when the container is in the second orientation. In particular, the actuator assembly 106 may shake the container $C_S$ by vigorously moving the container up and down and/or side to side. The containers $C_S$ typically contain a packing material, such as a piece of cotton, with the pharmaceuticals P and shaking the container helps ensure that all the pharmaceuticals flow out of the container and are not blocked by the packing material. Other suitable methods for shaking the container $C_S$ are within the scope of the present disclosure. After the pharmaceuticals P flow out of the container $C_S$, the gripper 102 may rotate the container back to the first orientation. Once the pharmaceuticals P move out of the container $C_S$, the container and holder 100A-C are moved back to the first location.

Referring back to FIG. 6, upon returning to the first location with the now empty container $C_S$, the gripper 102 of the holder 100A-C releases the container. In other words, the gripper 102 of the holder 100A-C is configured to receive the container $C_S$ when the holder is at the first location during a first period of time (e.g., the first time the container is at the first location) and is configured to release the container when the holder is at the first location during a second period of time, different than the first period of time (e.g., upon the container returning to the first location). When the container $C_S$ is released by the gripper 102, the container falls into another waste chute 134 of the waste collector 127 which directs the empty container $C_S$ to the waste bin 128 (FIG. 1). The container $C_S$ may fall directly into the waste chute 134 or fall into the discharge chute 108 which directs the container to the waste chute. After the gripper 102 releases the empty container $C_S$, the gripper is ready to receive another container from the container transporter 18, and the cycle repeats.

In one embodiment, the holders 100A-C are moved to another station every 6-8 seconds. This allows enough time for the actions at each location to be completed. Typically, cutting the pharmaceutical outlet 114 takes the longest amount of time and can vary depending on the wall thickness of the container $C_S$ and the size of the container. Thus, the pharmaceutical extractor 20 can receive a new container $C_S$ every 6-8 seconds with the processing of the container being completed in 18-24 seconds. Moreover, the singulator assembly 14 is timed, via the control system 200, to release a new container $C_S$ every 6-8 seconds to match the movement of the holders 100A-C between the different locations. This timing ensures that the container transported 18 will always have a container $C_S$ at the pickup location to deliver to the holders 100A-C, each time the holders are at the first location.

The operations or processes for removing the pharmaceuticals P from the container $C_S$ at each location occur generally at the same time (e.g., the processes occur generally simultaneously). For example, the first holder 100A receives a container $C_S$ at generally the same time as the cutter 112 cuts the pharmaceutical outlet 114 in a container held by the second holder 100B and at generally the same time as a third container held by the third holder 100C is moved to the second orientation to enable the pharmaceuticals P to move through the pharmaceutical outlet of the third container when the first, second and third holders are at the first, second and third locations, respectively. Simultaneously performing processes for removing the pharmaceuticals P from three containers $C_S$ significantly increases the speed at which the pharmaceutical container processing system 10 can remove pharmaceuticals from the containers (e.g., process containers). In one test, a pharmaceutical container processing system built according to the teachings of the present disclosure was able to process containers $C_S$ twice as fast over conventional systems at a rate of about 450-550 containers/hour, depending on the type of container.

It will be appreciated that container operations other than described herein could be performed at container operation locations, and various combinations of container operations could be performed at container operation locations without departing from the scope of the present application. For example, in one contemplated embodiment, full containers are received and cut at the same container operation location. In another embodiment, the containers are cut and emptied at the same container operation location. In yet another contemplated embodiment, the locations where the empty containers are dropped and the new containers are received can be different locations. Moreover, it will be appreciated that operations can be carried out in other fashions without departing from the scope of the present disclosure. For example, the containers could be received cap-end-down, could be cut while the cap end is up, could have the cap end cut off, or could be cut in other fashions.

Referring to FIG. 10, an exemplary control system of the pharmaceutical container processing system 10 is generally indicated by reference numeral 200. The control system 200 (broadly, a computer) includes a CPU or processor 202 (e.g., a control system processor) and RAM or memory 204 (broadly, non-transitory computer-readable storage medium). The control system 200 controls and operates the various components (e.g., conveyors 28A-C, actuators 42, actuator assemblies 106, etc.) of the pharmaceutical container processing system 10. Broadly, the memory 204 includes (e.g., stores) processor-executable instructions for controlling the operation of the pharmaceutical container processing system 10 and the components thereof. The instructions embody one or more of the functional aspects of the pharmaceutical container processing system and the components thereof, with the processor 202 executing the instructions to perform said one or more functional aspects. The components of the pharmaceutical container processing system 10 may be in wired or wireless communication with the control system 200. Other configurations of the control system 200 are within the scope of the present disclosure.

In one exemplary method of operation of the pharmaceutical container processing system 10, a plurality of containers $C_S$ are received in the hopper 12. The containers $C_S$ can be placed in the hopper 12 by the operator. The hopper 12 then dispenses the containers $C_S$ from the hopper and into the singulator assembly 14. Specifically, the conveyors 28A-C move to transport the containers to the singulator assembly. The singulator assembly 14 then singulates the containers $C_S$. The singulated container $C_S$ is then moved through the identification system 16, which identifies the container to confirm the container contains the correct pharmaceuticals P. The container $C_S$ is then moved to the stop assembly 66 where the container is stopped in the pickup location. The container $C_S$ is held in the pickup location until the container transporter 18 grabs the container and deliver's it to the pharmaceutical extractor 20.

One of the holders 100A-C (e.g., a first holder) of the pharmaceutical extractor 20 is at the first location of the pharmaceutical extractor and receives the container $C_S$ (e.g., a first container). Specifically, the container transporter 18 moves the first container $C_S$ to the gripper 102 of the first holder 100A and the gripper closes to grab and hold the first container therein. The container transporter 18 then releases the first container $C_S$ and moves back to the pickup location to grab another container $C_S$ therefrom. Once the first container $C_S$ is secured in the gripper 102 of the first holder 100A, the gripper then inverts the first container. The first holder 100A is then moved to the second location. Specially, the shaft 110 is rotated about the axis of rotation AR approximately 120 degrees to move the first holder 100A from the first location to the second location. As the first holder 100A holds the first container $C_S$ in the inverted (e.g., first) orientation at the second location, a pharmaceutical outlet 114 is formed in the first container. The blade 116 of the cutter 112 is moved through the first container $C_S$ to cut off the bottom portion of the container and form the pharmaceutical outlet 114. A stream of gas then pushes the bottom portion away from the remainder of the container $C_S$. The bottom portion is guided to the waste bin 128 by the shroud 124 and waste chute 126. The first holder 100A raises the first container $C_S$ into the path of the blade 116 and then lowers the first container after the pharmaceutical outlet 114 is formed. At generally the same time as the pharmaceutical outlet 114 is formed in the first container $C_S$ (e.g., at the same time the first holder 100A is in the second location), a second container is received in the third holder 100C. The third holder 100C was moved to first location from the third location at the same time the first holder 100A was moved to the second location. The third holder 100C receives the second container $C_S$ in the same manner as the first holder 100A, described above.

Once the pharmaceutical outlet 114 is formed in the first container $C_S$ and the third holder 100C receives the second container, the first holder 100A is moved to the third location. At generally the same time, the third holder 100C is moved to the second location and the second holder 100B is moved to the first location. The pharmaceutical outlet 114 in the second container $C_S$ is formed in the same manner as the pharmaceutical outlet formed in the first container, described above. Likewise, the second holder 100B receives a third container $C_S$ is the same manner as the first holder 100A, described above. In the third location, the first container $C_S$ is moved to a non-inverted (e.g., second) orientation so that the pharmaceuticals P in the first container move through the pharmaceutical outlet 114 and out of the first container. This occurs at generally the same time as the pharmaceutical outlet 114 is formed in the second container $C_S$ and the second holder 100B receives the third container (e.g., at the same time the second holder 100B is in the first location and the third holder 100C is in the second location). In particular, the gripper 102 of the first holder 100A rotates or generally flips the first container $C_S$ so that the pharmaceuticals P in the first container fall out of the first container and into the pharmaceutical collection inlet 136. The pharmaceutical chute 132 then guides the pharmaceuticals P to the pharmaceutical collector 26. The pharmaceutical collector 26 receives the pharmaceuticals P and then the operator can move the pharmaceuticals into the bulk container $C_B$. The first holder 100A may shake the first container $C_S$ to ensure that there are no pharmaceuticals P remaining in the first container. Once the first container 100A is empty, the first container may be moved back into the inverted orientation.

The first holder 100A is then moved back to the first location. At generally the same time, the third holder 100C is moved to the third location and the second holder 100B is moved to the second location. The pharmaceutical outlet 114 in the third container $C_S$, which is now in the second location, is formed, as described above. Likewise, the pharmaceuticals P are removed from the second container $C_S$, which is now in the third location, as described above. Upon returning to the first location, the first holder 100A drops the now empty first container into the waste chute 134 which guides the first container into the waste bin 128. Specifically, the gripper 102 releases the first container $C_S$. The first holder 100A is now ready to receive another (e.g., fourth) container from the container transporter 18 and the cycle repeats.

The Title, Field, and Background are provided to help the reader quickly ascertain the nature of the technical disclosure. They are submitted with the understanding that they will not be used to interpret or limit the scope or meaning of the claims. They are provided to introduce a selection of concepts in simplified form that are further described in the Detailed Description. The Title, Field, and Background are not intended to identify key features or essential features of the claimed subject matter, nor is it intended to be used as an aid in determining the claimed subject matter.

Although described in connection with an exemplary computing system environment, embodiments of the aspects of the disclosure are operational with numerous other general purpose or special purpose computing system environments or configurations. The computing system environment is not intended to suggest any limitation as to the scope of use or functionality of any aspect of the disclosure. Moreover, the computing system environment should not be interpreted as having any dependency or requirement relating to any one or combination of components illustrated in the exemplary operating environment. Examples of well-known computing systems, environments, and/or configurations that may be suitable for use with aspects of the disclosure include, but are not limited to, personal computers, server computers, hand-held or laptop devices, multiprocessor systems, microprocessor-based systems, set top boxes, programmable consumer electronics, mobile telephones, network PCs, minicomputers, mainframe computers, distributed computing environments that include any of the above systems or devices, and the like.

Embodiments of the aspects of the disclosure may be described in the general context of data and/or processor-executable instructions, such as program modules, stored one or more tangible, non-transitory storage media and executed by one or more processors or other devices. Generally, program modules include, but are not limited to, routines, programs, objects, components, and data structures that perform particular tasks or implement particular abstract data types. Aspects of the disclosure may also be practiced in distributed computing environments where tasks are performed by remote processing devices that are linked through a communications network. In a distributed computing environment, program modules may be located in both local and remote storage media including memory storage devices.

In operation, processors, computers and/or servers may execute the processor-executable instructions (e.g., software, firmware, and/or hardware) such as those illustrated herein to implement aspects of the disclosure.

Embodiments of the aspects of the disclosure may be implemented with processor-executable instructions. The processor-executable instructions may be organized into one or more processor-executable components or modules on a tangible processor readable storage medium. Aspects of the disclosure may be implemented with any number and organization of such components or modules. For example, aspects of the disclosure are not limited to the specific processor-executable instructions or the specific components or modules illustrated in the figures and described herein. Other embodiments of the aspects of the disclosure may include different processor-executable instructions or components having more or less functionality than illustrated and described herein.

The order of execution or performance of the operations in embodiments of the aspects of the disclosure illustrated and described herein is not essential, unless otherwise specified. That is, the operations may be performed in any order, unless otherwise specified, and embodiments of the aspects of the disclosure may include additional or fewer operations than those disclosed herein. For example, it is contemplated that executing or performing a particular operation before, contemporaneously with, or after another operation is within the scope of aspects of the disclosure.

When introducing elements of aspects of the disclosure or the embodiments thereof, the articles "a," "an," "the," and "said" are intended to mean that there are one or more of the elements. The terms "comprising," "including," and "having" are intended to be inclusive and mean that there may be additional elements other than the listed elements.

In view of the above, it will be seen that several advantages of the aspects of the disclosure are achieved and other advantageous results attained.

Not all of the depicted components illustrated or described may be required. In addition, some implementations and embodiments may include additional components. Variations in the arrangement and type of the components may be made without departing from the spirit or scope of the claims as set forth herein. Additional, different or fewer components may be provided and components may be combined. Alternatively or in addition, a component may be implemented by several components.

The above description illustrates the aspects of the disclosure by way of example and not by way of limitation. This description enables one skilled in the art to make and use the aspects of the disclosure, and describes several embodiments, adaptations, variations, alternatives and uses of the aspects of the disclosure, including what is presently believed to be the best mode of carrying out the aspects of the disclosure. Additionally, it is to be understood that the aspects of the disclosure is not limited in its application to the details of construction and the arrangement of components set forth in the description or illustrated in the drawings. The aspects of the disclosure are capable of other embodiments and of being practiced or carried out in various ways. Also, it will be understood that the phraseology and terminology used herein is for the purpose of description and should not be regarded as limiting.

Having described aspects of the disclosure in detail, it will be apparent that modifications and variations are possible without departing from the scope of aspects of the disclosure as defined in the appended claims. It is contemplated that various changes could be made in the above constructions, products, and methods without departing from the scope of aspects of the disclosure. In the preceding specification, various embodiments have been described with reference to the accompanying drawings. It will, however, be evident that various modifications and changes may be made thereto, and additional embodiments may be implemented, without departing from the broader scope of the aspects of the disclosure as set forth in the claims that follow. The specification and drawings are accordingly to be regarded in an illustrative rather than restrictive sense.

What is claimed is:

1. An item extractor comprising:

a plurality of grippers configured to hold at least one container of a plurality of containers, the at least one container being closed to hold a plurality of items, a plurality of operation locations arranged in a spaced apart series along which a series of operations are performed, a cutter located at a first operation location of the plurality of operation locations, the cutter including a container sensor to sense size of the container to control operation of the cutter engaging the at least one container, the cutter configured to cut the at least one container held by one of the plurality of grippers to create an outlet in the at least one container, an item collection inlet located at a second operation location of the plurality of operation locations, the item collection inlet configured to receive items from the outlet in the at least one container, and the plurality of grippers are configured to move, one gripper after another gripper, along the series of spaced apart operation locations to extract the items from the containers.

2. The item extractor according to claim 1, wherein the cutter cuts a bottom of the container to create the outlet.

3. The item extractor according to claim 2, wherein the cutter cuts the bottom completely off a remainder of the container to create the outlet.

4. The item extractor according to claim 3, wherein the plurality of grippers inverts the container with the bottom of the container being above a capped top of the container at the cutter.

5. The item extractor according to claim 4, wherein the plurality of grippers initially engage the container in an upright orientation with the capped top of the container being vertically above the bottom at the second operation location and then inverts the container from the second operation location to the first operation location prior to the cutter engaging the container.

6. The item extractor of claim 5, wherein the plurality of grippers is configured to repeatedly cycle through the series of spaced apart operation locations to perform the series of operations on additional containers of the plurality of containers.

7. The item extractor according to claim 3, further comprising an identification sensor to identify the at least one container to confirm the items in the at least one container.

8. The item extractor according to claim 1, wherein the plurality of grippers is configured to shake the plurality of containers to facilitate extracting the items from the outlet cut in the plurality of containers.

9. An item extractor comprising:

a first operation location, a second operation location, and a third operation location, arranged in a spaced apart series along which a series of operations are performed, a plurality of grippers configured to hold at least one container of a plurality of containers and move the at least one container from the first operation location to a second operation location and to the third operation location, the at least one container being closed to hold a plurality of items when engaged by one of the plurality of grippers, a cutter located at the second operation location, the cutter including a container sensor to sense size of a container to control operation of the cutter engaging the at least one container, the cutter configured to cut the at least one container held by one of the plurality of grippers to create an outlet in the at least one container, an item collection inlet located at the third operation location, the item collection inlet configured to receive items from the outlet in the at least one container, and the plurality of grippers are configured to move, one gripper after another gripper, along the series of spaced apart operation locations to extract the items from the containers.

10. The item extractor according to claim 9, wherein the cutter cuts a bottom of the container to create the outlet.

11. The item extractor according to claim 10, wherein the cutter cuts the bottom completely off a remainder of the container to create the outlet.

12. The item extractor according to claim 11, wherein the plurality of grippers inverts the container with the bottom of the container being above a capped top of the container at the cutter.

13. The item extractor according to claim 12, wherein the plurality of grippers initially engage the container in an upright orientation with the capped top of the container being vertically above the bottom at the first operation location and then inverts the container at the second operation location prior to the cutter engaging the container.

14. The item extractor according to claim 13, wherein the plurality of grippers are configured to repeatedly cycle through a sequential series of the first operation location, the second operation location, and the third operation location to perform the series of operations on additional containers of the plurality of containers.

15. The item extractor according to claim 11, further comprising an identification sensor to identify the at least one container to confirm the items in the at least one container.

16. The item extractor according to claim 9, further comprising a drive configured to rotate the grippers between the first operation location, the second operation location, and the second operation location.

17. The item extractor of claim 9, wherein the plurality of grippers is configured to drop empty containers at the first operation location before receiving another container at the first operation location.

18. The item extractor of claim 9, wherein the plurality of grippers is configured to shake the plurality of containers at the third operation location to facilitate extracting of the items from the outlet in the plurality of containers.

19. The item extractor according to claim 1, wherein the plurality of grippers initially engage the container in an upright orientation with a capped top of the container being vertically above the bottom at the second operation location and then inverts the container from the second operation location to the first operation location prior to the cutter engaging the container.

20. The item extractor according to claim 9, wherein the plurality of grippers initially engage the container in an upright orientation with a capped top of the container being vertically above the bottom at the first operation location and then inverts the container at the second operation location prior to the cutter engaging the container.

* * * * *